US005683166A

United States Patent [19]

Lutzker

[11] Patent Number: 5,683,166

[45] Date of Patent: Nov. 4, 1997

[54] ELECTROLUMINESCENT WALL PLATE

[76] Inventor: Robert S. Lutzker, 10 Woodstone Ct., South Huntington, N.Y. 11746

[21] Appl. No.: 643,492

[22] Filed: May 6, 1996

[51] Int. Cl.[6] ..... F21V 9/16

[52] U.S. Cl. ..... 362/84; 362/95; 250/466.1; 439/536

[58] Field of Search ..... 362/84, 95; 250/466.1; 200/333; 439/536, 592, 289

[56] References Cited

U.S. PATENT DOCUMENTS 3,307,030 2/1967 De Francisco ..... 362/95
5,485,356 1/1996 Nguyen ..... 362/95

*Primary Examiner*—Carroll B. Dority

[57] ABSTRACT

An electroluminescent wall plate is provided with clips designed to couple with wall mounted electrical terminals.

21 Claims, 3 Drawing Sheets

ELECTROLUMINESCENT WALL PLATE

FIELD OF THE INVENTION

This invention relates to electroluminescent wall panels or plates for switches and receptacles.

BACKGROUND OF THE INVENTION

Electroluminescent wall cover plates have been proposed in the prior art, such as U.S. Pat. No. 3,307,030. This patent discloses a custom built plug-in receptacle having three pairs of sockets, the conventional two pairs of plug-in sockets and a special central pair of sockets located in between the conventional sockets. An electroluminescent plate having a pair of prongs projecting outwardly from the rear surface of the plate are inserted into the special central pair of sockets. In another embodiment, the special central pair of sockets straddle a light switch. This prior art device is commercially unsatisfactory because it is custom built and requires a special unconventional socket assembly or switch assembly and a special unconventional plate with projecting prongs.

SUMMARY OF THE INVENTION

A principal object of the present invention is to provide an electroluminescent wall plate night light that does not require electrical wiring to an alternating current line or source and, at the same time, provides soft illumination for the plate, rooms and hallways.

Another object is to provide a wall plate of the foregoing type that will operate year round at minimum cost, will never burn out and is cool to the touch.

A further object is to provide a wall plate of the foregoing type with unique means for bringing power to the electroluminescent plate which may be a switch plate, receptacle plate or a combination thereof.

Other objects and advantages will become apparent from the following detailed description which is to be taken in conjunction with the accompanying drawings.

DETAILED DESCRIPTION

Figure 6:
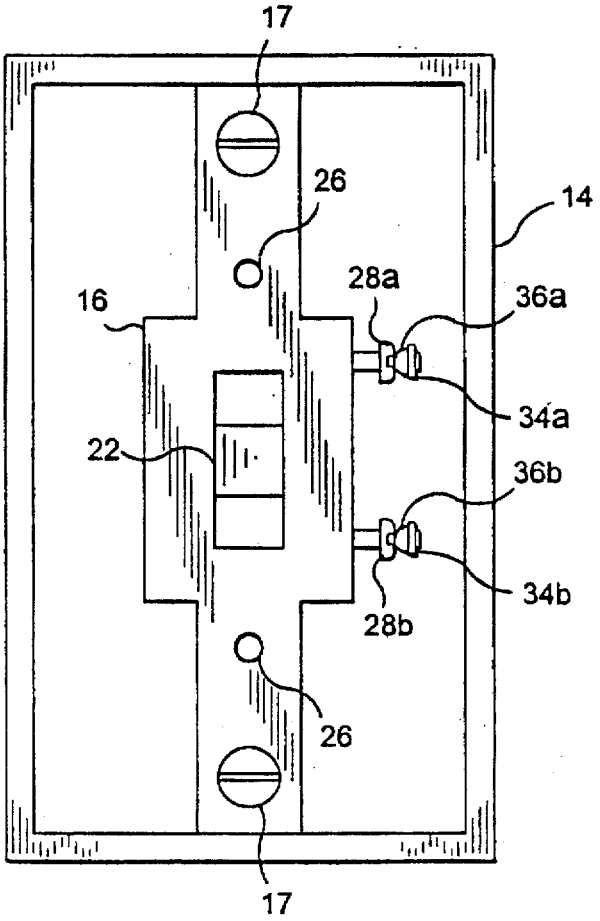
FIG. 6 is a front elevational view of an electrical box with a traditional or standard switch having a pair of side screw terminals having electrically coupled therewith the plate clips.

In the drawings, a wall switch plate incorporating an electroluminescent lamp or panel is generally indicated by numeral 10. The switch plate 10 includes back support plate 12 providing structural support and designed to cover the electric box 14 to which is secured switch 16 in a known and conventional manner (see FIG. 6) such as by screws 17. An electroluminescent panel 18 is advantageously placed flat against the front surface of support plate 12 and preferably within a recess therein and may be adhered thereto by glue, suitable adhesives or tape. The electroluminescent panel 18 may be an off-the-shelf item and obviously may assume any one of many configurations and geometric designs when applied to the front of plate 12, as for example, to cover a major part of the front of plate 12 as shown, or perhaps only its periphery or only a part of the front.

A cutout or opening 20 in the plate 12 and electroluminescent panel 18 accommodates a throw 22 of the switch 16. Screw holes 24 in both plate 12 and panel 18 permit screws (not shown) to pass therethrough and threadedly engage tapped openings 26 in switch 16.

Although a traditional switch plate 10 is illustrated, it should be understood any size or style of wall plate 12 can be employed, including a contemporary rocker; multi-switch and/or receptacle type or any combination thereof but preferably one that is commercially available.

Figure 1:
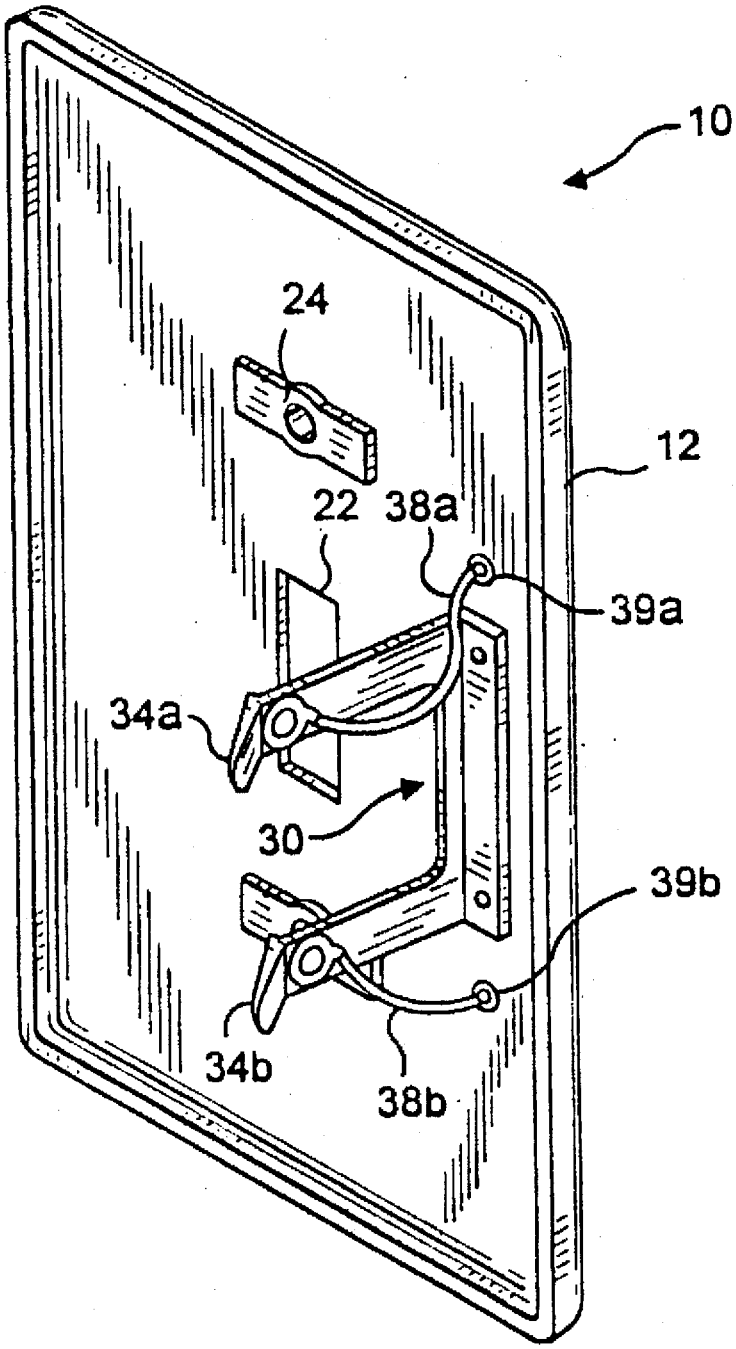
FIG. 1 is a rear perspective view of an electroluminescent wall switch plate of traditional style incorporating the teachings of the present invention.
Figure 2:
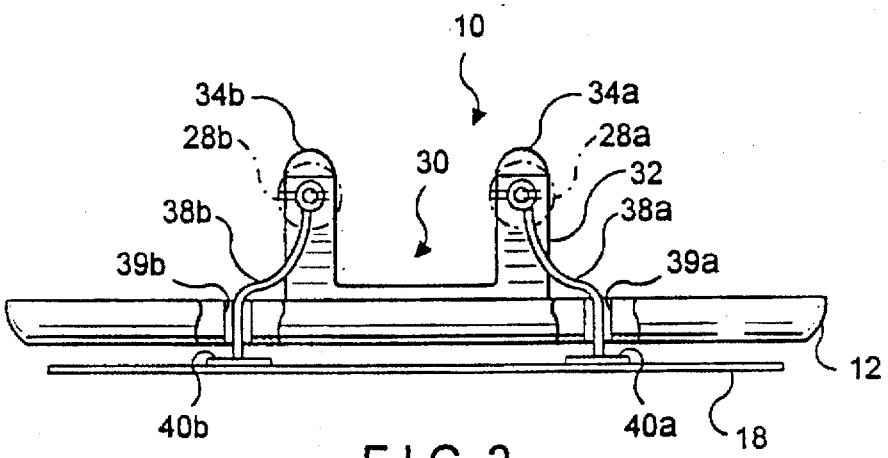
FIG. 2 is an exploded side view thereof partly broken away to show the electrical connection between the clips and the electroluminescent lamp or plate with the switch side screw terminals shown in phantom.
Figure 3:
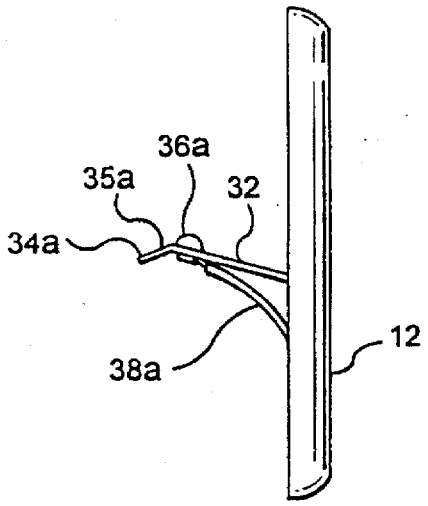
FIG. 3 is an end view thereof.
Figure 4:
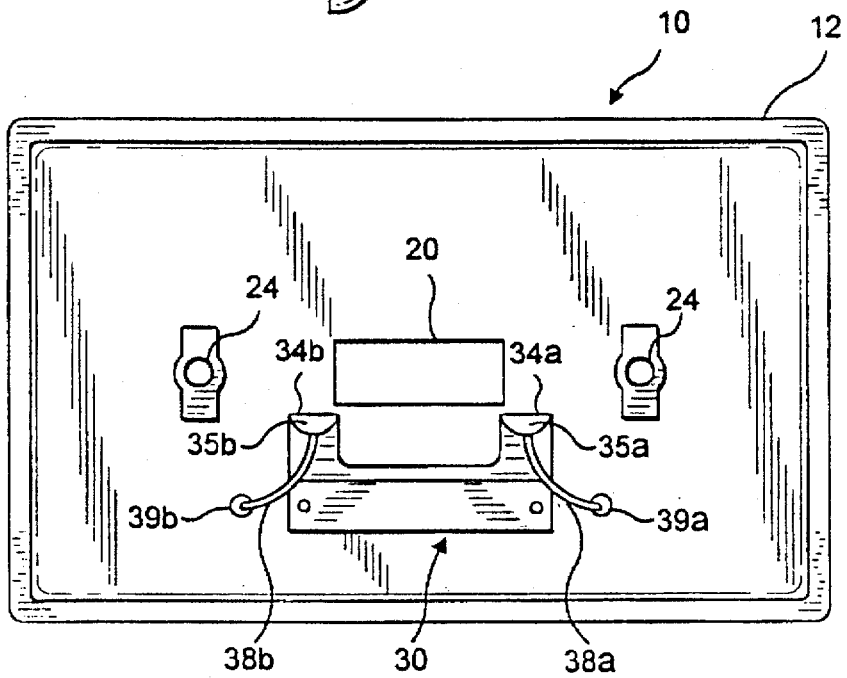
FIG. 4 is a bottom or rear plan view thereof.
Figure 5:
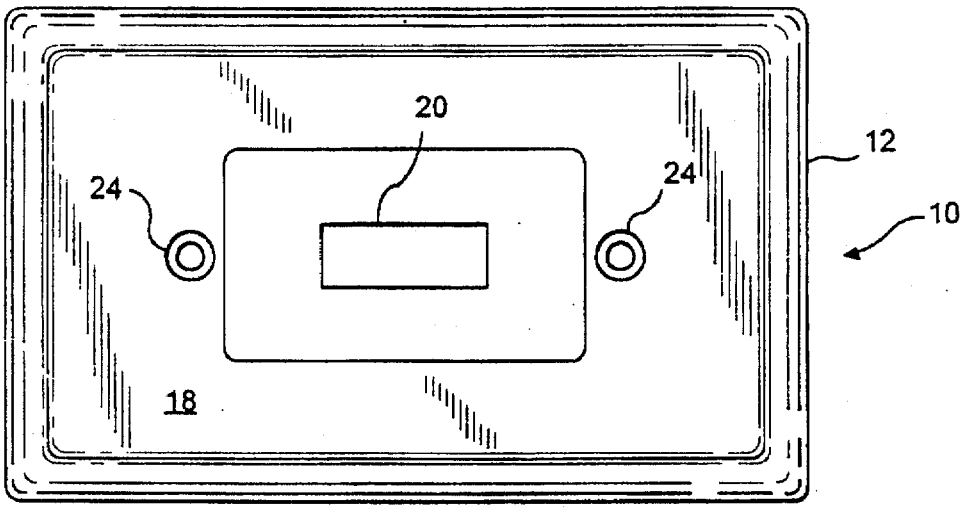
FIG. 5 is a top or front plan view thereof.

The switch 16 will normally be furnished with side screw terminals **28*a* and 28*b* which will be electrically connected to a source of electricity. In order to couple this source of electricity, through terminals 28*a* and 28*b* to electroluminescent panel 18, U-shaped clip assembly 30 is advantageously mounted on the interior of wall plate 12. Clip assembly 30 includes a cantilevered mounting bracket 32 of insulative material secured to the inner face of plate 12 in any suitable manner such as by adhesive, pins, rivets, etc. The bracket is formed with a pair of arms 34*a*, 34*b* possessing flexibility and tilted inwardly as shown in FIG. 3 each having a ramp 35*a*, 35*b* at its free end. Electrical contacts 36*a*, 36*b* are riveted or secured in any other suitable manner, inwardly of the free ends of the arms 34*a*, 34*b*, respectively. These contacts 36*a*, 36*b* will engage with terminals 28*a*, 28*b* when the switch plate 10 is secured to electrical box 14 with good firm contact provided by the flexure of the arms 34*a*, 34*b* which will be biased outwardly as the arm free ends cam against the terminals 28*a*, 28*b*. Electric wires 38*a*, 38*b* extend through holes 39*a*, 39*b* and are electrically connected to contacts 36*a*, 36*b* as well as conductive plates 40*a*, 40*b*, electrically connected to the inner face of electroluminescent panel 18 as shown in FIG. 2. Obviously, any other form of electrical connection between wires 38*a*, 38*b* and panel 18** could be employed such as coil springs, conductive epoxy, ink, etc.

Thus, in order to activate the electroluminescent panel 18, the wall plate 10 is mounted on the electrical box and secured to switch 16 by screws (not shown) extending through holes 24 and 26. During this mounting of the wall plate 10, arms **34*a*, 34*b* will flex and bias against terminals 28*a*, 28*b* to eventually place contacts 36*a*, 36*b*** into firm electrical engagement with those terminals. When this occurs, the electroluminescent panel will be energized.

Thus, the several aforenoted objects and advantages are most effectively attained. Although a single somewhat preferred embodiments has been disclosed and described in detail herein, this invention is in no sense limited thereby and its scope is to be determined by that of the appended claims.

I claim:

1. An apparatus for providing electrical power to a first device from a second device having an exposed terminal, the apparatus comprising;

a) an electrically insulative body portion having at least one resilient, elongated member extending therefrom;

b) a contact means mechanically attached to the elongated member for making electrical contact with the exposed terminal;

c) a connection means electrically connected to the contact means for carrying the electrical power from the second device, via the exposed terminal and the electrical contact, to the first device; and d) a wall plate, wherein the first device is an electroluminescent panel integrated with the wall plate.

2. The apparatus of claim 1 further comprising a ramp located proximate each end of the elongated members, whereby the ramp engages the terminal, flexes the elongated members and guides the contact means into physical contact with the terminal for facilitating electrical connection between the contact means and the terminal.

3. The apparatus of claim 1 having exactly two resilient, elongated members extending from the body portion.

4. The apparatus of claim 3 wherein the two elongated members form, with the body portion, a generally U-shaped clip.

5. The apparatus of claim 1 wherein the connection means is a wire.

6. The apparatus of claim 1 wherein the second device is a switch.

7. The apparatus of claim 6 further comprising a switch plate, the clip being attached to the back of the switch plate.

8. An apparatus for providing electrical power to a first device from a second device having an exposed terminal, the apparatus comprising;

a) an electrically insulative body portion having at least one resilient, elongated member extending therefrom;

b) a contact means mechanically attached to the elongated member for making electrical contact with the exposed terminal;

c) a connection means electrically connected to the contact means for carrying the electrical power from the second device, via the exposed terminal and the electrical contact, to the first device; and d) a wall plate, wherein the second device being a switch, a switch plate, a clip being attached to the back of the switch plate, the first device being an electroluminescent panel integrated with the switch plate.

9. The apparatus of claim 7 further comprising means for bringing the contact means into electrical contact with the exposed terminal when the switch plate is mounted over the switch.

10. The apparatus of claim 1 wherein the exposed terminal is a screw terminal.

11. The apparatus of claim 1 further comprising means for bringing the contact means into electrical contact with the exposed terminal.

12. The apparatus of claim 1 wherein the contact means is a rivet.

13. A clip mounted on a switch plate for drawing electrical current from an electrical switch, the electrical switch having two terminals for connection to an external circuit, both terminals located on the same side of the switch, the clip comprising:

a U-shaped, electrically insulative portion having first and second legs, each leg of the U-shaped portion being resilient and having a contact means;

means for forcing the legs of the U-shaped portion inward thereby making electrical connection between the contact means and the respective terminals;

a connection means electrically connected to the contact means for carrying current from the terminals to a separate device, the separate device being an electroluminescent panel.

14. In combination, a wall plate and an apparatus for providing electrical current to a first electrical device, said wall plate designed to cover a second electrical device having exposed terminals, the apparatus comprising:

a) a substantially U-shaped electrically insulative body portion;

b) an electrical contact means attached proximate the end of each leg of the U-shaped body;

c) connection means electrically connected to the contact means for carrying the electrical current from the second electrical device to the first electrical device via the contact means;

d) means for attaching the base of the U-shaped body portion to the back side of the wall plate such that the U-shaped body portion communicates with the wall plate and the second electrical device, whereby the contact means of the U-shaped apparatus move to make electrical contact with the exposed terminals of the second electrical device when the wall plate is affixed to the second electrical device;

e) the first device being an electroluminescent panel integrated into the wall plate.

15. The combination of claim 14 wherein the attachment means comprises means that promotes the rocking of the U-shaped body portion, thereby moving the legs into and out of engagement with the terminals of the second electrical device.

16. The combination of claim 14 wherein the connection means is a wire.

17. The combination of claim 14 wherein the second device is a switch.

18. In combination with a wall plate, an apparatus for facilitating the electrical connection between a first device and a second device recessed within a wall, the apparatus comprising:

a) an electrically insulative, resilient, elongated member extending from the back side of the wall plate, said elongated member including a ramp proximate the extended end;

b) a contact means attached to the elongated member for making electrical contact with a terminal of the second device;

c) a connection means electrically connected to the contact means, for connecting the second device, via the terminal and the contact means, to the first device, wherein said ramp engages said terminal as the wall plate is affixed to the second device, thereby flexing the elongated member as the ramp slides along the terminal and guiding the contact means into physical contact with the terminal; and d) the first device is an electroluminescent panel integrated into the wall plate.

19. In combination with a wall plate, an apparatus for facilitating the electrical connection between a first device and a second device recessed within a wall, the apparatus comprising:

a) an electrically insulative, resilient, elongated member extending from the back side of the wall plate, said elongated member including a ramp proximate the extended end;

b) a contact means attached to the elongated member for making electrical contact with a terminal of the second device;

c) a connection means electrically connected to the contact means, for connecting the second device, via the terminal and the contact means, to the first device, wherein said ramp engages said terminal as the wall plate is affixed to the second device, thereby flexing the elongated member as the ramp slides along the terminal and guiding the contact means into physical contact with the terminal; and d) the second device being a switch, the wall plate being a switch plate, and the first device being an electroluminescent panel integrated into the switch plate.

20. An electrical wall plate having an inner face and an outer face, an electroluminescent means mounted on the outer face for illuminating the plate, a clip assembly mounted on the inner face, said clip having a pair of outwardly extending flexible arms tilted towards the inner face and having free ends, electrical contacts at the free ends of the arms and electrical connection means for electrically connecting the contacts with the electroluminescent means.

21. An electrical assembly including the electrical wall plate of claim 20 and further including an electric box, an electrical device connected to the box and to a source of electric current, terminals on the electrical device also connected to the source of electric current, whereby mounting the wall plate on the electric box, biases the arms outwardly such that the contacts firmly engage the terminals to thereby supply electric current to the electroluminescent means.

* * * * *